United States Patent [19]

Perdue et al.

[11] Patent Number: 4,869,365

[45] Date of Patent: Sep. 26, 1989

[54] GOLF BAG ACCESSORY

[76] Inventors: Karen J. Perdue, 7415 Country Brook Dr., Indianapolis, Ind. 46260; Patricia S. Zaepfel, 1921 Eisenhower Dr., Speedway, Ind. 46224

[21] Appl. No.: 217,435

[22] Filed: Jul. 11, 1988

[51] Int. Cl.[4] ..... A63B 71/00

[52] U.S. Cl. ..... 206/315.5; 224/918; 224/919

[58] Field of Search ..... 224/918, 917, 274, 277, 224/252, 915; 206/315.2, 315.3, 315.5; 248/231.2, 213.2; 211/86, 87, 88, 126; 383/23, 38, 39

[56] References Cited

U.S. PATENT DOCUMENTS 4,350,194 9/1982 Brown ..... 206/315.5

4,768,650 9/1988 Chancellor ..... 206/315.3

FOREIGN PATENT DOCUMENTS 613456 1/1961 Canada ..... 224/915

*Primary Examiner*—Ernest G. Cusick
*Assistant Examiner*—Glenn T. Barrett
*Attorney, Agent, or Firm*—Craig A. Wood

[57] ABSTRACT

An accessory is disclosed to be detachably secured to a golf bag for carrying supplemental golf related and personal items. A plurality of quick release closeable pockets are columnarly mounted upon the exterior face of a generally rectangular panel. Removable attachment is made to a standard golf bag through the use of tensioned, hooked fasteners at the top and bottom of the rectangular panel.

7 Claims, 1 Drawing Sheet

GOLF BAG ACCESSORY

BACKGROUND OF THE INVENTION

1 Field of the Invention

The present invention generally relates to sports accessories and more particularly to golf bag accessories that are suitable to removably attach to the exterior surface of existing golf bags and capable of containing and carrying a variety of personal and golfing related items.

2 Description of the Prior Art

In the course of a round of golf, participants will generally carry along a number of golfing and personal items. Such items may include golf balls, golf tees, scorecards, golf ball markers, wallets, purses, combs, brushes, towels, keys, medications, cigarettes and lighters, and must either be carried on the person of the participant, carried separately, or carried in or attached to a golf bag. It is often desirable for such items to be maintained within a closeable container so as to deter accidental loss or theft prior to, during, and after play. Golf bags in present use generally have a number of zippered pockets permanently attached to the outer surface of the golf bag, so as to permit carrying of a relatively small number of personal and golfing related items.

Golfing accessories that are attachable to the exterior of an existing golf bag are disclosed by U. S. Pat. Nos. 715,759 and 1,718,952 with respect to the carrying of golf balls, disclosed by U. S. Pat. No. 1,739,780 with respect to the carrying of golf tees, disclosed by U. ,S. Pat. No. 4,459,827 with respect to the carrying of canned beverages, and disclosed by U. S. Pat. No. 4,032,054 with respect to the carrying of a variety of items.

Despite the availability of such articles, there exists a need in the art for a golf bag accessory that will permit the convenient containment and carrying of personal and golfing related items in addition to the capabilities of existing golf bags, yet is quickly, easily and inexpensively adapted for use in conjunction with a wide variety of existing golf bags, and is removable from the golf bag.

SUMMARY OF THE INVENTION

In order to aid in the understanding of the present invention, it can be stated in essentially summary form that it is directed to a golf bag accessory that is capable of removable attachment to existing golf bags and provides a plurality of closeable pockets for the containment and transportation of personal and golf related items. The golf bag accessory is formed from a generally rectangular panel attachable at the panel ends to the top and bottom of a golf bag. A plurality of quick release closeable pockets are columnarly mounted upon the exterior face of the panel. The rectangular panel and the pockets are constructed of sturdy, flexible, and moisture resistant sheeted material.

It is an object of the present invention to provide a golf bag accessory that is capable of carrying and containing a variety of personal and golf related items.

It is another object of the present invention to provide a golf bag accessory that may be used with a wide variety of existing golf bags.

It is another object of the present invention to provide a golf bag accessory that is lightweight yet sturdy.

It is another object of the present invention to provide a golf bag accessory that is inexpensive to produce.

It is still another object of the present invention to provide a golf bag accessory that may be used with substantially unmodified existing golf bags.

It is yet another object of the present invention to provide a golf bag accessory that is capable of being easily attached to and removed from golf bags.

Further objects and advantages of the present invention will be apparent from a study of the following portion of the specification, the claims, and the attached drawings.

DESCRIPTION OF THE PREFERRED EMBODIMENTS

The following portion of the specification, taken in conjunction with the drawings, sets forth the preferred embodiment of the present invention. The embodiment of the invention disclosed herein is the best mode contemplated by the inventors for carrying out their invention in a commercial environment, although it should be understood that various modifications can be accomplished within the parameters of the present invention.

Figure 1:
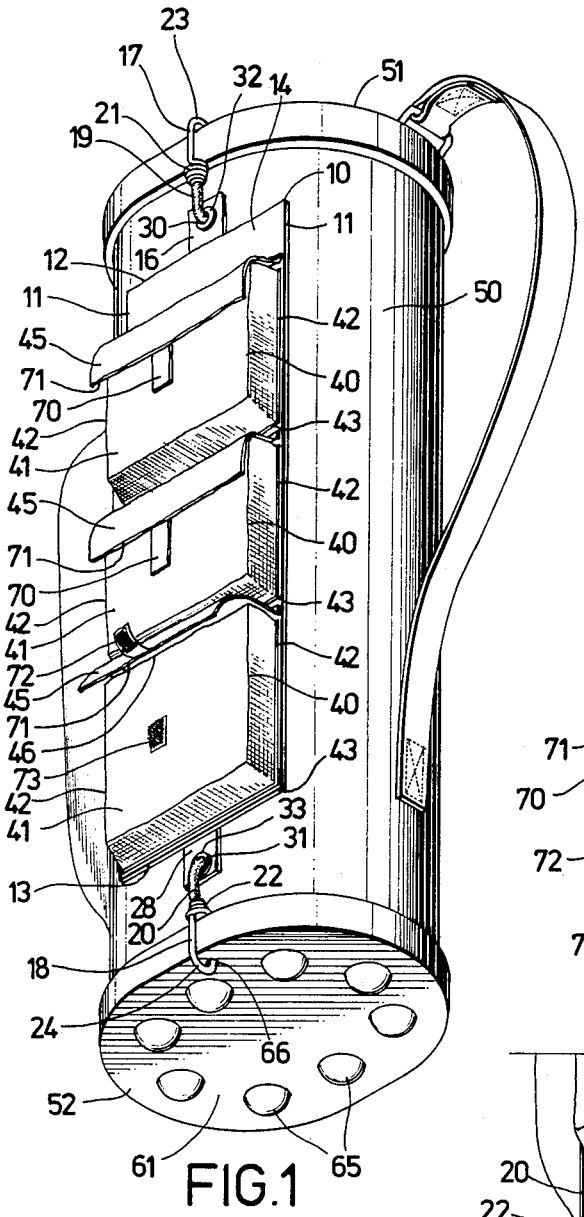
FIG. 1 is a perspective view of a golf bag accessory embodying the present invention mounted upon a golf bag.
Figure 2:
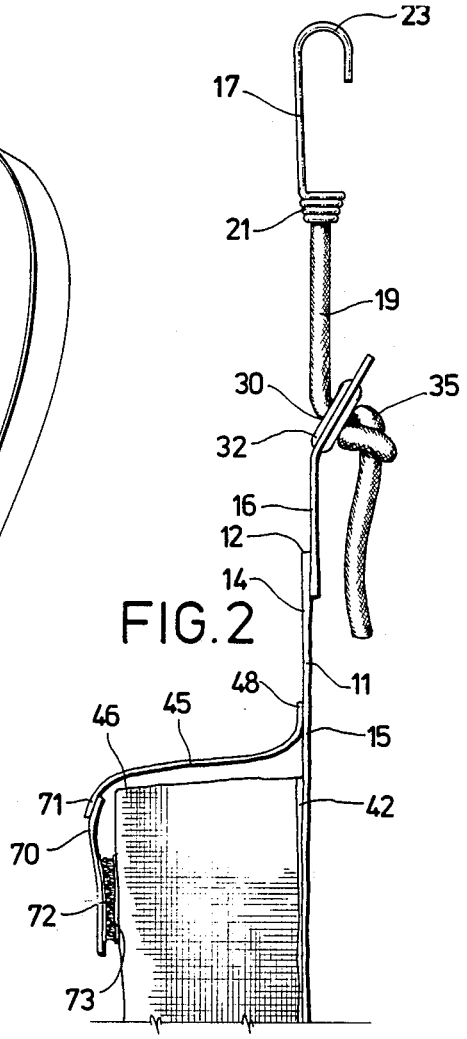
FIG. 2 is a side elevational partial view of a golf bag accessory embodying the present invention.

Referring now to the drawings for a detailed description of the present invention, reference is first made to FIGS. 1 and 2, showing generally rectangular panel 10 having side edges 11, top edge 12, bottom edge 13, exterior face 14 and interior face 15. Top tab 16, having top hole 30, is symmetrically attached to panel 10 along top edge 12, and bottom tab 28, having bottom hole 31, is similarly attached along bottom edge 13. Top grommet 32 is disposed through top hole 30, and bottom grommet 33 is disposed through bottom hole 31. Top elastic cord 19 and bottom elastic cord 20 are disposed through top grommet 32 and bottom grommet 33, respectively, and are limited in movement towards exterior face 14 by top knot 35 and bottom knot 36 (not shown), respectively. Top hook 17 is permanently attached at top hook spiral end 21 to top elastic cord 19, and removably attached at top hook attachment end 23 by disposing top hook attachment end 23 over golf bag upper edge 51 of golf bag 50. Similarly, bottom hook 18 is permanently attached at bottom hook spiral end 22 to bottom elastic cord 20, and removably attached, as hereinafter described, at bottom hook attachment end 24 to golf bag 50 at golf bag lower edge 52.

Columnarly oriented with respect to exterior face 14 are pockets 40, each having a distended, generally rectangular containment portion 41 attached to panel 10 along containment portion side edges 42 and containment portion bottom edge 43, but not attached along containment portion top edge 46, and each having a flap 45 attached to panel 10 along an upper flap edge 48, disposed to cover the containment portion top edge 46 immediately below. A pocket tab 70 is attached to each flap 45 along a lower flap edge 71, and an eye side Velcro strip 72 is attached to each pocket tab 70 so as to be disposed towards the particular containment portion 41 that each respective flap 45 is disposed to cover. A hook side Velcro strip 73 is attached to each containment portion 41 so as to be disposed to mate with one of the eye side Velcro strips 72.

The dimensions of the present invention are chosen so that the distance between top hook attachment end 23 of top hook 17 and lower hooked end 24 of bottom hook 18 when top and bottom elastic cords 19 and 20 are unstretched is less than the distance between golf bag upper edge 51 and golf bag lower edge 52, but when top and bottom elastic cords 19 and 20 are stretched, the distance between top hook attachment end 23 of top hook 17 and bottom hook attachment end 24 of bottom hook 18 is substantially equivalent to the distance between golf bag upper edge 51 and golf bag lower edge 52. In this manner, tension in top and bottom elastic cords 19 and 20 acts to cause flexible attachment of the present invention to golf bag 50.

The unstretched distance between top hook attachment end 23 of top hook 17 and bottom hook attachment end 24 of bottom hook 18 may be varied by loosening top and bottom knots 35 and tightening at the desired position along top and bottom elastic cords 19 and 20. In this manner, adjustment is made of the amount of tension in top and bottom cords 19 and 20, with the proper amount of tension in a particular application of the present invention dependent upon the small variations in the distance between golf bag upper edge 51 and golf bag lower edge 52, the weight and distribution of the contents to be carried within the present invention, and the personal tastes of the golfer.

Figure 3:
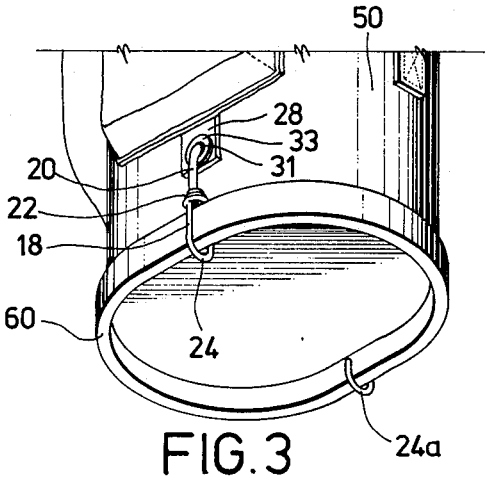
FIG. 3 is a perspective partial view of a golf bag accessory embodying the present invention mounted upon a golf bag.

Removable attachment of bottom hook 18 at bottom hook attachment end 24 to golf bag lower edge 52 is dependent upon the topological configuration of golf bag lower edge 52. As depicted in FIG. 1, in those instances where the present invention is used in conjunction with a golf bag 50 having a plurality of rounded protrusions 65 at golf bag bottom 61, a mounting hole 66, having diameter slightly larger than the cross-sectional diameter of lower hooked end 24 is drilled into golf bag bottom 61, and lower hooked end 24 is disposed within mounting hole 66. As depicted in FIG. 3, in those instances where the present invention is used in conjunction with a golf bag having a circular lip 60 at golf bag bottom 61, bottom hook attachment end 24 is disposed over lip 60. In the event that additional carrying capacity is desired, more than one unit of the present invention may be attached to golf bag 50, for example, as depicted by additional unit lower hooked end 24*a* in FIG. 3.

The present invention having been described in its preferred embodiments, it is clear that it is susceptible to numerous modifications and embodiments within the ability of those skilled in the art and without the exercise of the inventive faculty. Accordingly, the scope of the present invention is defined by the scope of the following claims.

What is claimed is:

1. Accessory, adapted to be detachably secured to a golf bag having a, top portion, a bottom portion and an exterior surface, comprising:

a generally rectangular panel having side edges top portion and the bottom portion of said golf bag, top and bottom edges each of dimension less than the dimension of said side edges, an exterior face and an interior face;

a plurality of closeable pockets attached columnarly to the exterior face of said panel; and means for detachably securing the top edge of said panel to the top portion of said golf bag and bottom edge of said panel to the bottom portion of said golf bag, disposed with the interior face of said panel proximate to the exterior surface of said golf bag. wherein said means includes:

a top tab attached to the top edge of said panel;

a bottom tab attached to the bottom edge of said panel;

a top hook removably attachable to the top portion of said golf bag;

a bottom hook removably attachable to the bottom portion of said golf bag; and means for securing said top hook to said top tab and said bottom hook to said bottom tab so as to provide tension urging said top tap towards the top portion of said golf bag and urging said bottom tab towards the bottom portion of said golf bag.

2. Accessory as defined in claim 1, wherein each of said pockets comprises:

a generally rectangular containment portion having an upper side, a lower side, a left side and a right side, attached to the exterior face of said panel on said left side, said right side and said lower side, disposed with said upper side most proximate to the top edge of said panel and disposed to protrude away from said exterior face;

a flap portion attached to the exterior face of said panel disposed towards the top edge of said panel and capable of covering the upper side of said containment portion; and means for removably attaching said flap portion to the upper side of said containment portion.

3. Accessory as defined in claim 2 wherein said means for removably attaching said flap portion to the upper side of said containment portion comprises:

a pocket tab attached to said flap portion disposed towards the bottom edge of said panel;

an eye side Velcro strip attached to said pocket tab disposed towards said containment portion; and a hook side Velcro strip attached to said containment portion disposed to mate with said eye side Velcro strip.

4. Accessory as defined in claim 1, wherein said panel and said pockets are formed of a flexible, liquid resistant sheet material.

5. Accessory, adapted to be detachably secured to a golf bag having a top portion, a bottom portion and an exterior surface, comprising:

a rectangular panel having side edges of dimension less than the distance between the top portion and the bottom portion of said golf bag, top and bottom edges of dimension less than the dimension of said side edges, an exterior face and an interior face;

a plurality of generally rectangular containment portions each having an upper side, a lower side, a left side and a right side, attached columnarly to the exterior face of said panel on said left side, said right side and said lower side, disposed with said upper side most proximate to the top edge of said panel and disposed to protrude away from said exterior face;

rectangular flap portions equal in number to said containment portions, each having greater edges of dimension substantially equivalent to the dimension of the top and bottom edges of said panel, each disposed towards the top edge of said panel with respect to one of said containment portions and with said greater edges parallel to the top and bottom edges of said panel, attached along one of said greater edges to the exterior face of said panel, and each capable of covering the upper side of one of said containment portions;

means for removably attaching each of said flap portions to the upper side of one of said containment portions; and means for detachably securing the top edge of said panel to the top portion of said golf bag and the bottom edge of said panel to the bottom portion of said golf bag, disposed with the interior face of said panel proximate to the exterior surface of said golf bag. said means includes:

a top tab attached to the top edge of said panel;

a bottom tab attached to the bottom edge of said panel;

a top hook removably attached to the top portion of said golf bag;

a bottom hook removably attachable to the bottom portion of said golf bag; and means for securing said top hook to said top tab and said bottom hook to said bottom tab so as to provide tension urging said top tab towards the top portion of said golf bag and urging said bottom towards the bottom portion of said golf bag.

6. Accessory as defined in claim 5 wherein said means for removably attaching said flap portion to the upper side of said containment portion comprises:

a pocket tab attached to said flap portion disposed towards the bottom edge of said panel;

an eye side Velcro strip attached to said pocket tab disposed towards said containment portion; and a hook side Velcro strip attached to said containment portion disposed to mate with said eye side Velcro strip.

7. Accessory as defined in claim 6, wherein said panel and said pockets are formed of a flexible, liquid resistant sheet material.

* * * * *